US005598056A

United States Patent [19]

Jin et al.

[11] Patent Number: 5,598,056

[45] Date of Patent: Jan. 28, 1997

[54] MULTILAYER PILLAR STRUCTURE FOR IMPROVED FIELD EMISSION DEVICES

[75] Inventors: Sungho Jin, Millington; Gregory P. Kochanski, Dunellen; Wei Zhu, North Plainfield, all of N.J.

[73] Assignee: Lucent Technologies Inc., Murray Hill, N.J.

[21] Appl. No.: 380,774

[22] Filed: Jan. 31, 1995

[51] Int. Cl.[6] ..... H01J 1/88

[52] U.S. Cl. ..... 313/495; 313/309; 313/336

[58] Field of Search ..... 313/495, 496, 313/497, 309, 336, 351; 428/690

[56] References Cited

U.S. PATENT DOCUMENTS

| | | | |
|---|---|---|---|
| 4,940,916 | 11/1988 | Borel et al. | 313/306 |
| 5,063,323 | 11/1991 | Longo et al. | 313/336 |
| 5,070,282 | 12/1991 | Epsztein | 313/336 |
| 5,124,664 | 6/1992 | Cade et al. | 313/309 |
| 5,129,850 | 7/1992 | Kane et al. | 445/24 |
| 5,138,237 | 8/1992 | Kane et al. | 315/349 |
| 5,150,019 | 9/1992 | Thomas et al. | 313/309 |
| 5,283,500 | 2/1994 | Kochanski | 315/58 |
| 5,463,269 | 10/1995 | Zimmerman | 313/309 |
| 5,473,218 | 12/1995 | Moyer | 313/309 |

FOREIGN PATENT DOCUMENTS

| | | |
|---|---|---|
| 0404022 | 12/1990 | European Pat. Off. . |
| 0616354 | 9/1994 | European Pat. Off. . |

OTHER PUBLICATIONS

R. Hawley, "Solid Insulators in vacuum: A review," *Vacuum*, vol. 18, No. 7 pp. 383–390 (1968).

Dec. 1991 issue of *Semiconductor International*, p. 46 "Flat Panel Displays: What's All the Fuss About?".

C. A. Spindt et al. "Field–Emitter Arrays for Vacuum Microelectronics," *IEEE Transactions on Electron Devices*, vol. 38, pp. 2355–2363 (1991).

I. Brodie et al, *Advances in Electronics and Electron Physics* edited by P. W. Hawkes, vol. 83, pp.. 75–87 (1992).

J. A. Costellano, *Handbook of Display Technology* Academic Press, NY, pp. 254–257 (1992).

Okano et al., "Fabrication of a diamond field emitter array", *Appl. Phys. Lett*, vol. 64, p 2742 (1994).

R. Hawley, *Vacuum*, vol. 18, p. 383 (1968).

*Primary Examiner*—Louis M. Arana
*Assistant Examiner*—Matthew J. Esserman
*Attorney, Agent, or Firm*—Glen E. Books; Patricia A. Verlangieri

[57] ABSTRACT

In accordance with the invention, a field emission device is provided with an improved pillar structure comprising multi-layer pillars. The pillars have a geometric structure that traps most secondary electrons and an exposed surface that reduces the number of secondary electrons. Processing and assembly methods permit low-cost manufacturing of high breakdown-voltage devices, including flat panel displays.

3 Claims, 4 Drawing Sheets

MULTILAYER PILLAR STRUCTURE FOR IMPROVED FIELD EMISSION DEVICES

FIELD OF THE INVENTION

This invention pertains to field emission devices and, in particular, field emission devices, such as flat panel displays, having an improved pillar structure using a multi-layer material configuration.

BACKGROUND OF THE INVENTION

Field emission of electrons into vacuum from suitable cathode materials is currently the most promising source of electrons in vacuum devices. These devices include flat panel displays, klystrons and traveling wave tubes used in microwave power amplifiers, ion guns, electron beam lithography, high energy accelerators, free electron lasers, and electron microscopes and microprobes. The most promising application is the use of field emitters in thin matrix-addressed flat panel displays. See, for example, J. A. Costellano, *Handbook of Display Technology* Academic Press, New York, pp. 254 (1992), which is incorporated herein by reference. Diamond is a desirable material for field emitters because of its low voltage emission characteristics and robust mechanical and chemical properties. Field emission devices employing diamond field emitters are disclosed, for example, U.S. patent application Ser. No. 08/361616 filed by Jin et al. Dec. 22, 1994. This application is incorporated herein by reference.

A typical field emission device comprises a cathode including a plurality of field emitter tips and an anode spaced from the cathode. A voltage applied between the anode and cathode induces the emission of electrons towards the anode.

A conventional electron field emission flat panel display comprises a flat vacuum cell having a matrix array of microscopic field emitters formed on a cathode of the cell (the back plate) and a phosphor coated anode on a transparent front plate. Between cathode and anode is a conductive element called a grid or gate. The cathodes and gates are typically skewed strips (usually perpendicular) whose intersections define pixels for the display. A given pixel is activated by applying voltage between the cathode conductor strip and the gate conductor. A more positive voltage is applied to the anode in order to impart a relatively high energy (400–3,000 eV) to the emitted electrons.

The anode layer is mechanically supported and electrically separated from the cathode by pillars placed sparsely so as not to drastically reduce the field emission areas of the display. In order to withstand the high voltage applied to the anode for phosphor excitation, the pillar material should be dielectric and should have high breakdown voltage.

One of the limiting factors in the display performance in the fiat panel, field emission display (FED) is the allowable maximum operating voltage between the cathode emitter and the anode. The measured efficiency for typical ZnS-based phosphor, (e.g. the P22 red, green, and blue, as commercially available from GTE) increases approximately as the square-root of the voltage over a wide voltage range, so a field emission display should be operated at as high a voltage as possible to get maximum efficiency. This is especially important for portable, battery-operated devices in which low power consumption is desirable. The applicants have also found that the electron dose that phosphors can survive without substantial degradation of their luminous output similarly increases with operating voltage. It is not generally recognized that the combination of these two effects makes it especially advantageous to operate at high voltage. The display needs to produce the same light output, irrespective of its operating voltage. Since the efficiency improves at high voltage, less total power must be deposited on the anode. Further, since the power is the anode voltage times the current, the current required to maintain a constant light output decreases even faster than the power. When this is combined with the above-mentioned increase in dose required to damage the phosphor, the lifetime is found to be a strongly increasing function of the voltage. For a typical phosphor, we anticipate that changing the operating voltage from 500 V to 5000 V would increase the device's operating lifetime by a factor of 100.

Most practical field emission displays require integrated dielectric pillars to keep the substrate and screen separated. Without these pillars, the pressure difference between a normal atmosphere outside and vacuum inside will flex the anode and the cathode surfaces together. Because of the insulator breakdown in high electrical fields, these pillars put limitations on the voltage that can be applied to the display, and consequently limit the phosphor efficiency and thus the power consumption. The voltage limitation arises because it is necessary to avoid electric discharges along the surface of the pillars.

There is a substantial amount of knowledge on surface breakdown on insulators in vacuum, see a review paper by R. Hawley, Vacuum, vol. 18, p. 383 (1968). For insulator surfaces oriented parallel to the electric field, typical electric fields at which breakdown occurs seem to be no better than $10^4$ V/cm (e.g., 5000 V across a 5 mm length). This is dramatically lower than the $1–10\times10^6$ V/cm that most solid insulators will support through the bulk. Smaller dielectric objects will support larger electric fields, for example, 200 μm high pillars will typically support about $2–5\times10^4$ V/cm, but the overall voltage (which is field times height) is still a monotonic function of height.

Since field emission displays with ZnS-based phosphors are desirably operated at 2000 V or more (even more desirably at 4000 V or more), a straight-walled pillar would have to be 0.5 mm–1 mm tall (allowing for a safety factor of 1.5). Such tall pillars lead to difficulties in keeping the electrons focussed as they travel between emitter and the phosphor screen.

The applicants are not aware of any literature that discusses the effects of electron bombardment on dielectric breakdown, but it seems likely that it will decrease the breakdown voltages further, and thus require yet taller pillars.

If we consider an insulating surface in a vacuum containing a few electrons, the insulator surface will generally become charged. The sign of the charge is not necessarily negative. Incoming electrons can knock electrons off the insulator, a process known as secondary emission. If, on average, there is more than one outgoing electron per incoming electron, the insulator will actually charge positively. The positive charge can then attract more electrons. This process doesn't run away on an isolated block of insulator, because the positive charge eventually prevents the secondary electrons from leaving, and the system reaches equilibrium.

However, if we put the insulator between two electrodes and establish a continuous voltage gradient across the insulator, the secondary electrons can always hop toward the more positive electrode. One can get a runaway process where most of the insulator becomes positively charged (to a potential near that of the most positive electrode) so that the voltage gradients near the negative electrode becomes very strong. These stronger gradients can lead to field emission from the negative electrode, and another cycle of charging and emission. This process can lead to the formation of an arc across the surface long before the insulator would break down through the bulk. Accordingly there is a need for novel and convenient methods for producing and assembling a pillar structure with desirable geometrical configurations and dielectric properties.

SUMMARY OF THE INVENTION

In accordance with the invention, a field emission device is provided with an improved pillar structure comprising multi-layer pillars. The pillars have a geometric structure that traps most secondary electrons and an exposed surface that reduces the number of secondary electrons. Processing and assembly methods permit low-cost manufacturing of high breakdown-voltage devices, including fiat panel displays.

BRIEF DESCRIPTION OF THE DRAWING(S)

The nature, advantages and various additional features of the invention will appear more fully upon consideration of the illustrative embodiments now to be described in detail in connection with the accompanying drawings. In the drawings.

Figure 3A:
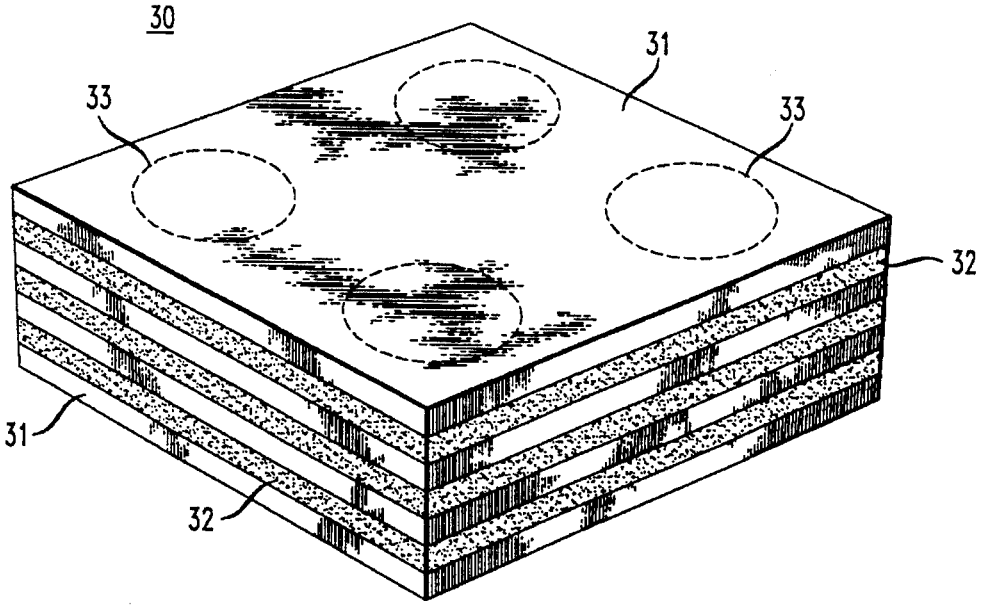
Figure 3B:
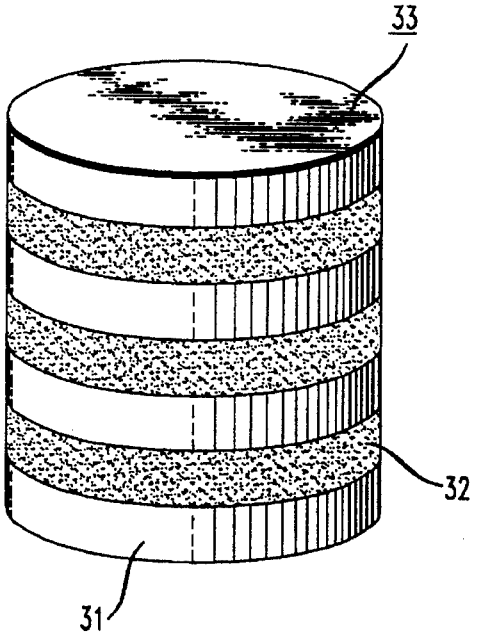
Figure 3C:
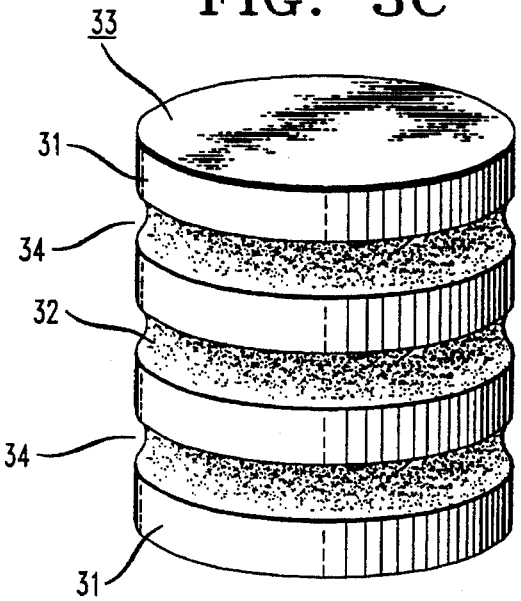
Figure 4:
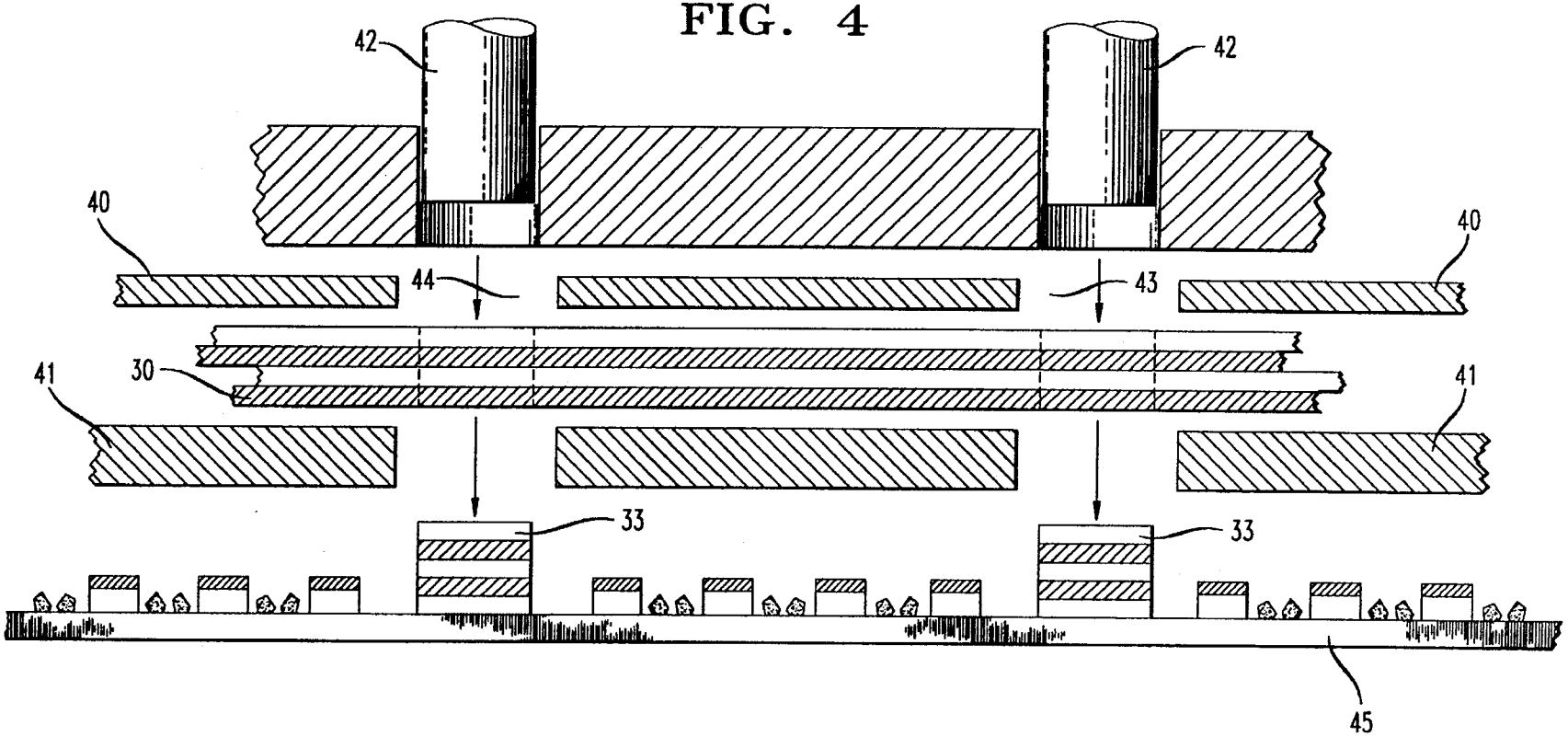
Figure 5:
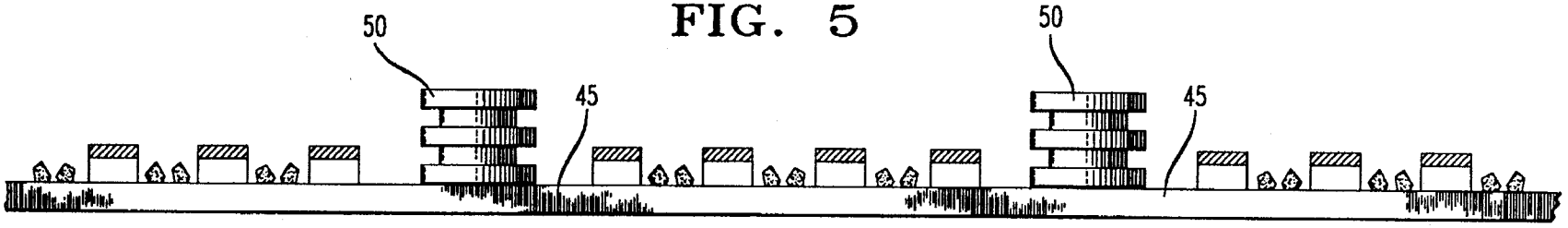
Figure 6:
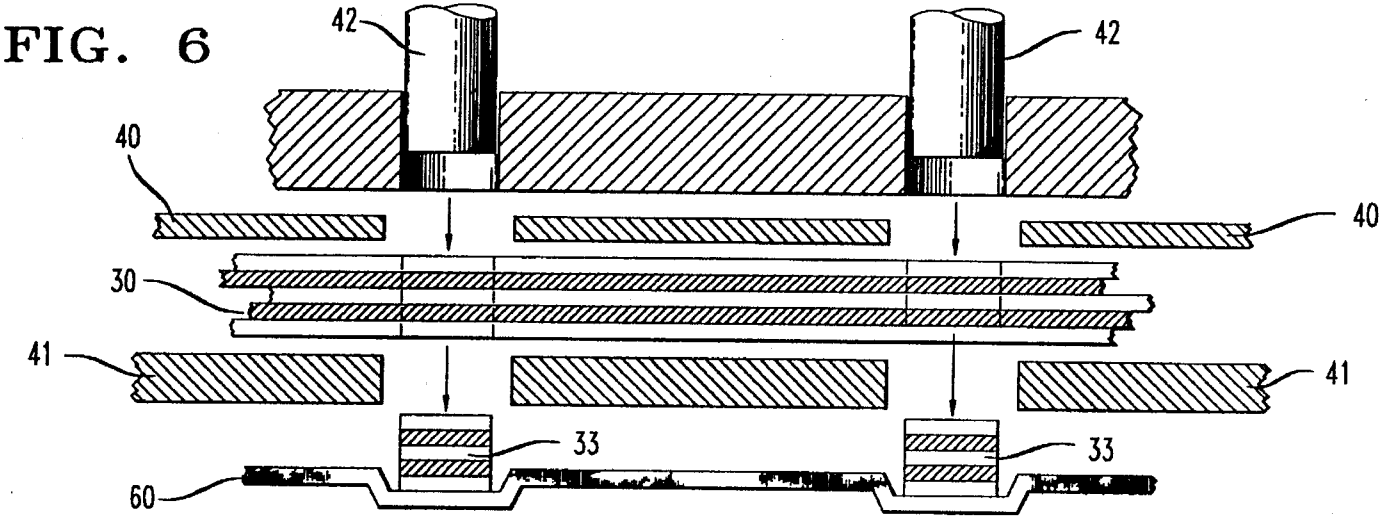
Figure 7:
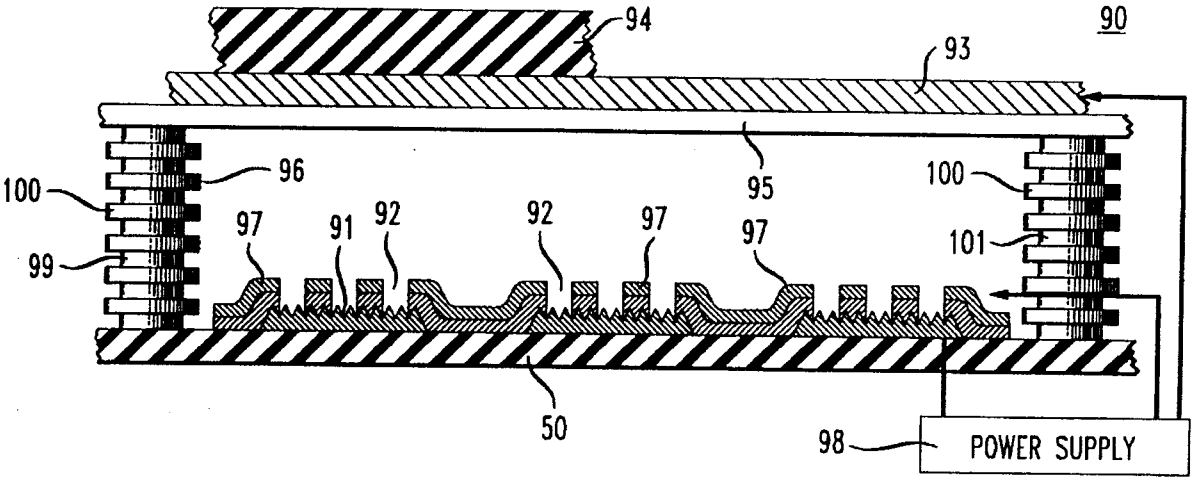

FIGS. 3A, 3B and 3C schematically illustrates the processing of the multilayer pillars;

FIG. 4 schematically illustrates an exemplary process of depositing a multitude of the multilayer pillars simultaneously on the FED display cathode;

FIG. 5 schematically illustrates the cathode structure with the improved pillars in place;

FIG. 6 schematically illustrates an alternative process of placing the multilayer pillar precursors at pre-determined locations on a carrier tray for additional groove shaping treatments before transferring them onto the display cathode surface; and FIG. 7 is a schematic diagram of a field emission flat panel display device employing the pillars of this invention.

It is to be understood that the drawings are for purposes of illustrating the concepts of invention and are not to scale.

DETAILED DESCRIPTION

This description is divided into three parts. Part I describes an improved electron emission device using multilayer pillars. Part II describes considerations in pillar design, and Part HI describes the fabrication of devices having multilayer pillars.

I. Devices Using Multilayer Pillars

Referring to the drawings, FIG. 7 is a schematic cross section of an exemplary field emission device, here a flat panel display 90, using high breakdown voltage multilayer pillars. The device comprises a cathode 91 including a plurality of emitters 92 and an anode 93 disposed in spaced relation from the emitters within a vacuum seal. The anode conductor 93 formed on a transparent insulating substrate 94 is provided with a phosphor layer 95 and mounted on support pillars 96 Between the cathode and the anode and closely spaced from the emitters is a perforated conductive gate layer 97.

The space between the anode and the emitter is sealed and evacuated, and voltage is applied by power supply 98. The field-emitted electrons from electron emitters 92 are accelerated by the gate electrode 97 from multiple emitters 92 on each pixel and move toward the anode conductive layer 93 (typically transparent conductor such as indium-tin-oxide) coated on the anode substrate 94. Phosphor layer 95 is disposed between the electron emitters and the anode. As the accelerated electrons hit the phosphor, a display image is generated.

In accordance with the invention, pillars 96 are multilayer structures comprising alternating layers of insulator 99 and conductor 100. Preferably the insulating layers 99 are recessed with respect to the conductor layers 100 to define a plurality of grooves 101. The grooved surface structure increases the breakdown resistance by increasing the surface distance between the electrodes. In addition, the grooved structure traps many secondary electrons.

The multilayer structure consisting of alternating layers of dielectric material and conductive material is particularly advantageous because when field emitted electrons from the cathode impinge upon a conductive region, the undesirable multiplication of outgoing electrons typically seen on insulator surfaces is minimized, permitting higher operating voltages, shorter pillars and more nearly cylindrical geometry.

II. Pillar Design

There are five considerations in optimal pillar design. First, the optimal pillar design is one where surface paths on dielectric material from negative to positive electrodes are as long as possible for a given height of the pillar. Second, it is desirable to construct the pillar so that most secondary electrons will re-impact the pillar surface close to the point of their generation, rather than being accelerated a substantial distance toward the positive electrode. This goal is advantageous because most materials generate less than one secondary electron for each incident electron if the incident energy is less than 500 V (or more preferably, less than 200 V). Under these conditions, secondary electrons will generally not have enough energy to make an increasing number of secondaries of their own. For the purposes of this goal, "close" is defined as a point where the electrostatic potential is less than 500 V more positive than the point at which the electron is generated, and preferably less than 200 V more positive. Third, it is desirable to construct the pillar out of materials that have secondary electron emission coefficients of less than two, under the normal operating conditions. Fourth, it is desirable to have as much of the surface of the pillar oriented so that the local electric field is nearly normal to the insulator surface, preferably with the field lines emerging from the surface, so that secondary electrons will be pulled back toward the surface and re-impact with energies less than the abovementioned 200–500 V. It is known that a conical pillar that has the electric field coming out of the insulator surface at 45 degrees from the normal can hold off as much as four times the voltage then a pillar with walls parallel to the field will support. Fifth, the pillar must not be so much wider at the anode end that it substantially reduces the area that can be allocated to the phosphor screen.

The pillars in the field emission devices mechanically support the anode layer above the pillars and electrically separate the cathode and anode. Therefore, mechanical strength as well as dielectric properties of the pillar material are important. In order to withstand the high electrical field applied to operate the phosphor material which is typically coated on the anode plate, the pillar material should be an electrical insulator with high breakdown voltage, e.g. greater than about 2000 V and preferably greater than 4000 V for using the established phosphors such as the ZnS:Cu,Al phosphor.

III. Fabrication Of Devices Having Multilayer Pillars

Figure 2:
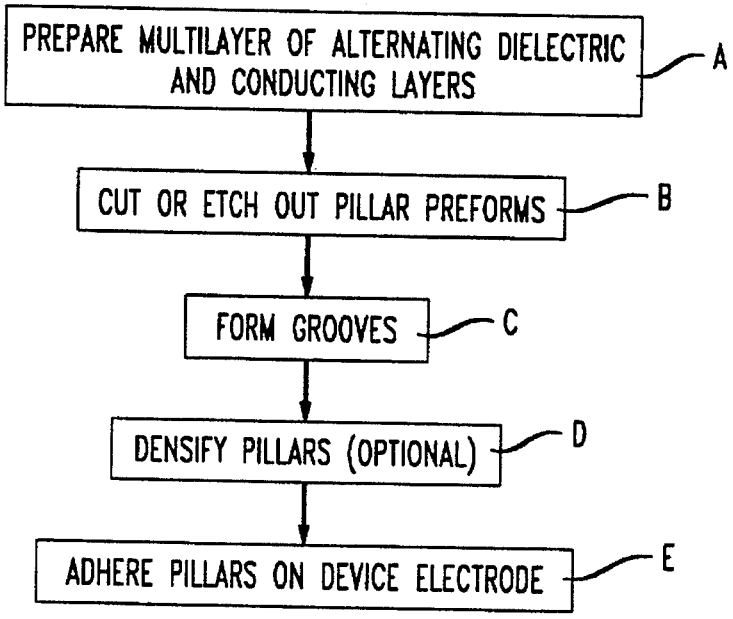
FIG. 2 is a block diagram of the steps involved in a method of making a multilayer pillar structure in accordance with the invention.

Improved pillars according to the invention, can be constructed as illustrated in the flow diagram of FIG. 2. The first step (block A in FIG. 2) is to prepare a multi-layered composite precursor consisting of alternate dielectric and conductive layers. FIG. 3A shows an exemplary precursor 30 comprising alternate conductive layers 31 and insulating layers 32. Regions to be cut out as pillar preforms are indicated by the reference numeral 33.

A suitable pillar insulating material according to the invention may be chosen from glasses such as lime glass, pyrex, fused quartz, ceramic materials such as oxide, nitride, oxynitride, carbide (e.g., $Al_2O_3$, $TiO_2$, $ZrO_2$, AlN) or their mixture, polymers (e.g., polyimide resins and teflon) or composites of ceramics, polymers, or metals. A typical geometry of the pillar in this invention is a modified form of either round or rectangular rod. A cylinder, plate, or other irregular shape can be used. The diameter of the pillar is typically 50–1000 μm, and preferably 100–300 m. The height-to-diameter aspect ratio of the pillar is typically in the range of 1–10, preferably in the range of 2–5. The desired number or density of the pillars is dependent on various factors to be considered. For sufficient mechanical support of the anode plate, a larger number of pillars is desirable. However, in order to minimize the loss of display quality, the manufacturing costs and risk of electrical breakdown, too many pillars are not desirable, and hence some compromise is necessary. A typical density of the pillar in this invention is about 0.01–2% of the total display surface area, and preferably 0.05–0.5%. For a FED display of about 25×25 $cm^2$ area, approximately 500–2000 pillars each with a cross-sectional area of 100×100 μm is typical.

Suitable pillar conductive or semiconductive materials include metals or alloys (e.g., Co, Cu, Ti, Mn, Au, Ni, Si, Ge) or compounds (e.g., $Cu_2O$, $Fe_2O_3$, $Ag_2O$,$MoO_2$ $Cr_2O_3$). These materials have generally low secondary electron emission coefficient $\delta_{max}$ of less than 2, e.g., 1.2 for Co, 1.3 for Cu, 1.1 for Si, 1.2 for $Cu_2O$, 1.0 for $Ag_2O$ and 1.2 for $MoO_2$. The coefficient is defined as the ratio of number of outgoing electrons/number of incoming electrons on a given surface of the material. Insulators typically have high secondary electron emission coefficient of 2–20, e.g., 2.9 for glass and ~20 for MgO.

In these pillar designs, there is an allowable tradeoff between the material properties (i.e. $\delta_{max}$ and the conductivity) and the geometry of the pillars. In order to reduce the undesirable multiplication of electrons, it is necessary that the average number of secondary electrons that are generated by an incident electron and then travel through enough of a potential drop to generate more than one tertiary electron be less than unity. We define a tertiary electron as a secondary electron produced from a secondary electron that has been accelerated into a surface. The secondary electron typically must have 200–1000 eV of energy on impact with the surface in order to generate more than one tertiary electron. This threshold energy is referred to as $E_o$, and is available in standard tables for each material.

The conductive materials are incorporated into the multilayer structure as follows. A first slurry-like or suspension-like mixture containing a dielectric particles such as glass frits, a liquid carrier (water or solvent), and optionally a binder such as polyvinyl alcohol is prepared by thorough mixing. A second slurry-like mixture containing conductive or semiconductive particles, a liquid carrier, and optionally a binder, (and also optionally some dielectric particles such as glass frits with preferably less than 60% in volume as compared to the conductor volume) is similarly prepared. The desired particles sizes are 0.1–20 μm. These two mixtures are alternately deposited on a flat substrate using known ceramic processing technique such as spray coating, doctor blading, etc., with intermediate drying or semi-sintering process to form a multilayer composite. Alternatively, thin sheets of metal and precursor sheets of binder containing dielectric composite may be alternately stacked up. A soft metal such as Au is especially desirable because it is easy to be cut inside the multilayer, and is resistant to etching by hydrofluoric acid typically used for etching of glass type dielectric layer. A thin adhesion-enhancing metal film such as Ti may optionally be coated on the surface of the metal layer. Another variation in processing is to spray-coat the first mixture on metal sheets which are then stacked up.

The typical thickness of individual layers is 5–500 μm, and preferably 20–100 μm. The overall thickness of the multi-layer composite is in the same order as the desired pillar height, typically in the range of 150–2000 μm.

The second step in FIG. 2 (block B) is to cut out or etch out approximately pillar-sized preforms. For example, round (or rectangular) rods, typically 30–300 μm dia. or plates of 30–300 μm thickness can be cut out from the multi-layer composite by various means such as mechanical cutting, punching out, or laser cutting. FIG. 3B illustrates a typical pillar preform 33.

The pillar preforms are then subjected to differential etching treatment (block C in FIG. 2) so that the dielectric layers are etched out more than the metallic layers so as to form the finished pillar of FIG. 3C having grooves 34.

Figure 1:
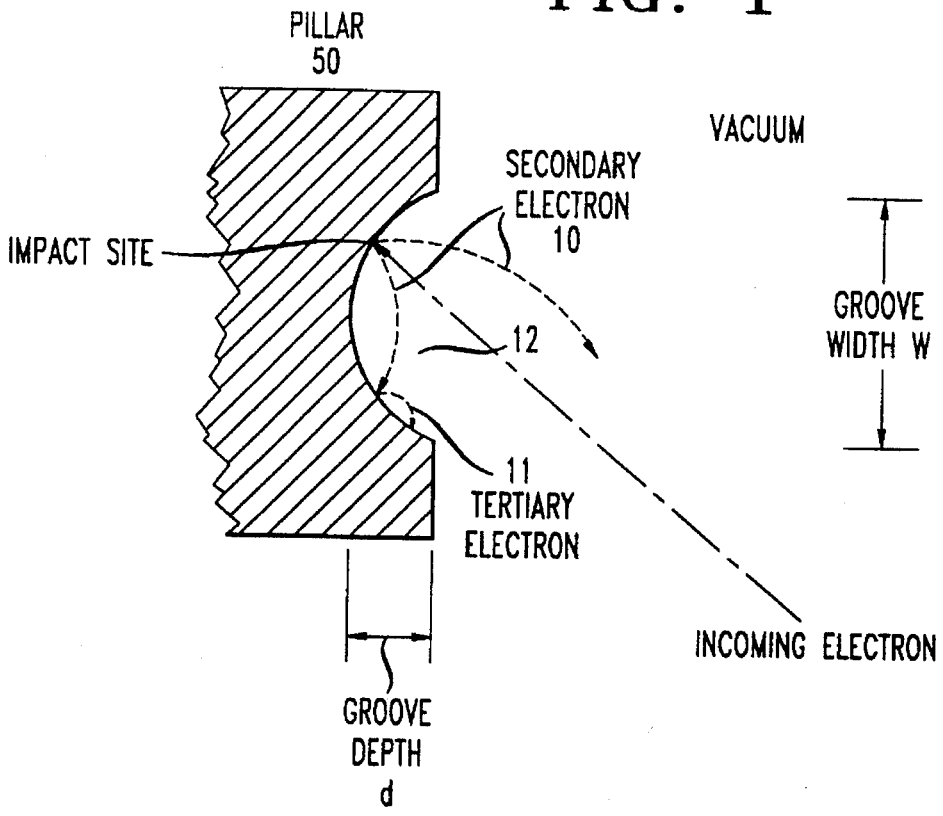
FIG. 1 is a drawing describing the relationship between the geometry of the pillar and electron multiplication.

As shown in FIG. 1, which shows a pillar 50 with a deep groove 12, not all secondary electrons 10 will travel far enough to have gained more energy than $E_o$ so that they will make more than one tertiary electron 11. Surfaces with deep grooves 12 (where the depth of the groove d is greater than 0.3 times the width), are preferred, and surfaces where the groove depth is greater than the width (d/w>1.0) are especially preferred, because a large fraction of secondary electrons collide with the surface before they have acquired much energy. Consequently, materials with higher $\delta_{max}$ require grooves with a greater ratio of d/w. Also as will be apparent from FIG. 1, the voltage difference across a groove must be smaller than $E_o/q$ (q is the electron charge), for the above argument to hold. Consequently, the desired number of grooves along the length of the pillar according to the invention, is typically greater than $Vq/E_o$, and preferably greater than 2 $Vq/E_o$. Thus, pillars with large $E_o$ require fewer grooves.

The sintering, densification or melting of the dielectric particles in the first layer and the conductive particles in the second layer, which is shown in FIG. 2 (block D), can be carried out, either fully or partially, before or after the differential etching step. In the case of glass layer and gold sheet composite preform, hydrofluoric acid preferentially etches the glass resulting in the desired multilayer, grooved, pillar geometry with the conductive layer protruding so as to reduce the secondary electron emission.

The sintering (or melting) and etching processes may be applied on the pillar preform either as individual parts, or as many parts simultaneously placed on the device substrate or on a carder tray.

Instead of differential etching, an alternative way of producing the desired grooved structure is to use differential shrinkage of the first layer and the second layer. Depending on the concentration of the slurry mixture, higher concentration of liquid carrier (to be evaporated later) and binder (to be pyrolized later) in the dielectric layer than in the conductive layer will lead to more shrinkage in the dielectric layer during densification processing (sintering, melting, etc.) thus resulting in the desired, grooved multi-layer pillar structure with recessed dielectric layers.

While most of the discussions here have concerned multilayers consisting of alternating conductive and dielectric layers, the principles of this invention may be applied to create a grooved (or corrugated) pillar structure consisting of two dielectric materials. The two dielectric materials would have different-etch rate or shrinkage rate so that the desired grooves are formed. The applicants also consider the possibility of multilayer structure consisting of three or more materials as a simple extension of this invention.

The next step, shown as block E of FIG. 2, is to adhere the pillars to a device electrode, preferably the emitter cathode. This can be done by punching the pillar preforms in place on the electrode with a thermally activated adhesive in place or by applying the finished pillars with pick-and-place machinery.

FIG. 4 illustrates apparatus useful in making field emission devices in accordance with the invention comprising an apertured upper die 40, lower die 41 and a plurality of punches 42. The die apertures 43 and 44 are aligned with positions on a device electrode 45 (here a cathode emitter) where pillars are to be adhered, and a multilayer preform 30 can be inserted between dies 40 and 41. Pillar preforms 33 are then punched into position on electrode 45. The pillar preforms 33 can be grooved and adhered to the electrode by the application of heat.

FIG. 5 illustrates an alternative approach in which the pillars are punched, grooves are formed and then the finished pillars 50 are placed on electrode 45 by pick-and-place machinery (not shown) where they are adhered as by thermally activated adhesive.

FIG. 6 illustrates apparatus useful in the approach of FIG. 5, showing that the punching arrangement of FIG. 4 can be used to place the punched pillar preforms 45 onto a pillar carrier tray 60 for groove formation and presentation to pick-and-place machinery.

It is to be understood that the above-described embodiments are illustrative of only a few of the many possible specific embodiments which can represent applications of the principles of the invention. For example, the high breakdown voltage pillars of this invention can be used not only for flat-panel display apparatus but for other applications, such as a x-y matrix addressable electron sources for electron lithography or for microwave power amplifier tubes. Thus numerous and varied other arrangements can be made by those skilled in the art without departing from the spirit and scope of the invention.

We claim:

1. In a field emission device comprising an emitter cathode, an anode and a plurality of insulating pillars separating said cathode and anode, the improvement wherein:

at least one of said plurality of insulating pillars comprises a multilayer structure composed of alternating conducting layers and insulating layers;

wherein said insulating layers are recessed with respect to said conducting layers to form grooves in said at least one of said plurality of insulating pillars.

2. The device of claim 1 wherein at least one of said grooves has a depth d greater than 0.3 times the groove width.

3. The device of claim 1 wherein at least one of said grooves has a depth d greater than 1.0 times the groove width.

* * * * *